US007840019B2

(12) United States Patent
Slaney et al.

(10) Patent No.: US 7,840,019 B2
(45) **Date of Patent: *Nov. 23, 2010**

(54) ESTIMATION OF HEAD-RELATED TRANSFER FUNCTIONS FOR SPATIAL SOUND REPRESENTATION

(75) Inventors: Malcolm Slaney, Los Altos Hills, CA (US); Michele Covell, Los Altos Hills, CA (US); Steven E. Saunders, Cupertino, CA (US)

(73) Assignee: Interval Licensing LLC, Seattle, WA (US)

( * ) Notice: Subject to any disclaimer, the term of this patent is extended or adjusted under 35 U.S.C. 154(b) by 1409 days.

This patent is subject to a terminal disclaimer.

(21) Appl. No.: 11/274,013

(22) Filed: Nov. 14, 2005

(65) Prior Publication Data

US 2006/0067548 A1 Mar. 30, 2006

Related U.S. Application Data

(63) Continuation of application No. 09/369,340, filed on Aug. 6, 1999, now Pat. No. 6,996,244.

(60) Provisional application No. 60/095,442, filed on Aug. 6, 1998.

(51) Int. Cl.
*H04R 5/02* (2006.01)
*H04R 5/00* (2006.01)

(52) U.S. Cl. ..... 381/303; 381/17; 381/309; 381/310

(58) Field of Classification Search ..... 381/17, 381/303, 309, 310
See application file for complete search history.

(56) References Cited

U.S. PATENT DOCUMENTS

| | | | | |
|---|---|---|---|---|
| 5,386,689 | A * | 2/1995 | Bozich et al. | 60/803 |
| 6,128,608 | A * | 10/2000 | Barnhill | 706/16 |
| 6,181,800 | B1 * | 1/2001 | Lambrecht | 381/310 |
| 6,243,476 | B1 * | 6/2001 | Gardner | 381/303 |
| 6,996,244 | B1 * | 2/2006 | Slaney et al. | 381/303 |

OTHER PUBLICATIONS

Elizabeth A. Cohen, Ph.D., "Technologies for Three Dimensional Sound Presentation Issues in Subjective Evaluation of the Spatial Image" Cohen Acoustical, Inc., Los Angeles, CA, Feb. 26, 1998, pp. 1-7.

Drucker et al., " Support Vector Regression Machines" Bell Labs and Monmouth University, Department of Electronic Engineering, West Long Branch, NJ 07764, 7 pages.

Doris J. Kistler, "A model of head related transfer functions based on principal components analysis and minimum-phase reconstruction" J. Acoust. Soc. Am, vol. 91, No. 3, Mar. 1992, pp. 1637-1647.

Chris Kyriakakis, "Fundamental and Technological Limitations of Immersive Audio Systems", Proceedings of the IEEE, vol. 86, No. 5, May 1998, pp. 941-951.

* cited by examiner

*Primary Examiner*—Devona E Faulk
(74) *Attorney, Agent, or Firm*—Perkins Coie LLP

(57) ABSTRACT

The estimation of an HRTF for a given individual is accomplished by means of a coupled model, which identifies the dependencies between one or more images of readily observable characteristics of an individual, and the HRTF that is applicable to that individual. Since the HRTF is highly influenced by the shape of the listener's outer ear, as well as the shape of the listener's head, images of a listener which provides this type of information are preferably applied as an input to the coupled model. In addition, dimensional measurements of the listener can be applied to the model. In return, the model provides an estimate of the HRTF for the observed characteristics of the listener.

9 Claims, 3 Drawing Sheets

| Posn 1 | | Posn 2 | | Posn 3 | | ... | Posn n | |
|---|---|---|---|---|---|---|---|---|
| $M_L P_L$ | $M_R P_R$ | $M_L P_L$ | $M_R P_R$ | $M_L P_L$ | $M_R P_R$ | ... | $M_L P_L$ | $M_R P_R$ |

| | Observable Data | | | | | | Hidden Data | | | | | |
|---|---|---|---|---|---|---|---|---|---|---|---|---|
| Indiv 1 | $I_{1,1}$ | $I_{1,2}$ | $I_{1,3}$ | $I_{1,4}$ | ... | $I_{m,n}$ | $P_1$ | $P_2$ | $P_3$ | $P_4$ | ... | $P_n$ |
| Indiv 2 | $I_{1,1}$ | $I_{1,2}$ | $I_{1,3}$ | $I_{1,4}$ | ... | $I_{m,n}$ | $P_1$ | $P_2$ | $P_3$ | $P_4$ | ... | $P_n$ |
| Indiv 3 | $I_{1,1}$ | $I_{1,2}$ | $I_{1,3}$ | $I_{1,4}$ | ... | $I_{m,n}$ | $P_1$ | $P_2$ | $P_3$ | $P_4$ | ... | $P_n$ |
| Indiv 4 | $I_{1,1}$ | $I_{1,2}$ | $I_{1,3}$ | $I_{1,4}$ | ... | $I_{m,n}$ | $P_1$ | $P_2$ | $P_3$ | $P_4$ | ... | $P_n$ |
| Indiv 5 | $I_{1,1}$ | $I_{1,2}$ | $I_{1,3}$ | $I_{1,4}$ | ... | $I_{m,n}$ | $P_1$ | $P_2$ | $P_3$ | $P_4$ | ... | $P_n$ |
| ⋮ | | | | | | | | | | | | |
| Indiv k | $I_{1,1}$ | $I_{1,2}$ | $I_{1,3}$ | $I_{1,4}$ | ... | $I_{m,n}$ | $P_1$ | $P_2$ | $P_3$ | $P_4$ | ... | $P_n$ |

ESTIMATION OF HEAD-RELATED TRANSFER FUNCTIONS FOR SPATIAL SOUND REPRESENTATION

CROSS REFERENCE TO OTHER APPLICATIONS

This application is a continuation of co-pending U.S. patent application Ser. No. 09/369,340, entitled ESTIMATION OF HEAD-RELATED TRANSFER FUNCTIONS FOR SPATIAL SOUND REPRESENTATION filed Aug. 6, 1999,now U.S. Pat. No. 6,996,244 which is incorporated herein by reference for all purposes, which claims priority to U.S. Provisional Application No. 60/095,442, entitled ESTIMATION OF HEAD-RELATED TRANSFER FUNCTIONS FOR SPATIAL SOUND REPRESENTATION filed Aug. 6, 1998 which is incorporated herein by reference for all purposes.

FIELD OF THE INVENTION

The present invention is generally directed to the reproduction of sounds, and more particularly to the estimation of head-related transfer functions for the presentation of three-dimensional sound.

BACKGROUND OF THE INVENTION

Sound is gaining increasing interest as an element of user interfaces in a variety of different environments. Examples of the various uses of sound include human/computer interfaces, auditory aids for the visually impaired, virtual reality systems, acoustic and auditory information displays, and teleconferencing. To date, sound is presented to the user in each of these different environments by means of headphones or a limited number of loudspeakers. In most of these situations, the sounds perceived by the user have limited spatial characteristics. Typically, the user is able to distinguish between two dipolar sources, e.g. left and right balance, but is otherwise unable to distinguish between different virtual sources of sounds that are theoretically located at a variety of different positions, relative to the user.

It is desirable to utilize the three-dimensional aspect of sound, to enhance the user experience in these various environments, as well as provide a greater amount of information. Unlike vision, the user's aural input is not limited to the direction in which he or she is looking at a given instant. Rather, the human auditory system permits individuals to identify and discriminate between sources of information from all surrounding locations. Consequently, efforts have been directed to the accurate synthesis of three-dimensional spatial sound which permits the user to distinguish between multiple different sources of information.

To accurately synthesize sound in a virtual three-dimensional environment, one factor which must be taken into account is the position-dependent changes that occur when a sound wave propagates from a sound source to the listener's eardrum. These changes result from diffraction of the sound wave by the torso, head and ears of the listener. Such diffractions are in turn influenced by the azimuth, elevation and range of the listener relative to the source. The changes in sounds which occur by these influencing factors as they travel from the source to the listener's eardrum can be quantified in a transfer function known as the head related transfer function (HRTF). In general, the HRTF can be characterized as a table of finite impulse responses which is indexed according to azimuth and elevation, as well as range in some cases. The HRTF has become a valuable tool in the characterization of acoustic information, and therefore widely employed in various types of research that are directed to sound localization in a three dimensional environment.

Since the HRTF is highly dependent upon the physique of the listener, particularly the size of the head, neck and shoulders, and the shapes of the outer ears, or pinnae, it can vary significantly from one person to the next. As a result, the HRTF is sufficiently unique to an individual that appreciable errors can occur if one person listens to sound that is synthesized or filtered in accordance with a different person's HRTF. To provide truly accurate spatial sound for a given individual, therefore, it is necessary to employ an HRTF which is appropriate to that individual. In an environment which is confined to a limited number of listeners, it might be feasible to explicitly determine the HRTF for each potential user. Typically, this is carried out by measuring the response at the listener's eardrums to a number of different signals from sound sources at different locations, by means of probe microphones that are placed within the listener's ears, as close as possible to the eardrum. Using this technique, it is possible to obtain an HRTF that is specific to each individual. For further information regarding the measurement of an HRTF, see Blauert, J., Spatial Hearing, MIT Press, 1983, particularly at Section 2.2, the disclosure of which is incorporated herein by reference While this direct measurement approach may be feasible for a limited number of users, it will be appreciated that it is not practical for applications designed to be used by a large number of listeners. Accordingly, efforts have been undertaken to model the HRTF, and thereafter compute an HRTF for a given individual from the model. To date, much of the effort at modeling the HRTF has focused upon principle components analysis. For a detailed discussion of this approach, reference is made to Kistler et al, "A Model of Head-Related Transfer Functions Based On Principle Components Analysis and Minimum-Phase Reconstruction," J. Acoust. Soc. Am. 91 (3), March 1992, pages 1637-1647.

These attempts to characterize the HRTF have met with limited success, since they only provide a rough basis for an estimation model, but do not actually couple characteristics of the listener to his or her HRTF. Consequently, the principle components analysis does not provide a mechanism to find the best HRTF for a given user. Other attempts have been made to model the HRTF on the basis of the physics of sound propagation. See, for example, C. P. Brown and R. O. Duda, "A Structural Model for Binaural Sound Synthesis," IEEE Trans. Speech and Audio Processing, Vol. 6, No. 5, pp. 476-488 (September 1998). While this approach appears to provide more accurate results, the need to obtain the necessary physical measurements can be inconvenient and time consuming, and therefore may not be practical in all situations. In addition, the physical principles that determine the HRTF are not all known, and therefore the model may not be truly representative. It is therefore desirable to provide an accurate technique for estimating the HRTF of an individual on the basis of a limited amount of input information, particularly where direct measurement of the individual is not always possible or feasible.

SUMMARY OF THE INVENTION

In accordance with the present invention, images of a person's ears, and/or other physical features of the person, are used to determine an HRTF for that person. Along these lines, a simple approach to map images to HRTFs, using a collection of images and dimensions, is described by Kyrikakis, "Fundamental and Technological Limitations of Immersive Audio Systems," Proceedings of the IEEE, Volume 86, No. 5, May 1998, pp. 941-95 1. The present invention employs a database of images and HRTFs as well, but uses the data to build a detailed model coupling two sets of data More particularly, images of a person's head, torso, and ears are converted into an estimate of how sounds in three dimensional-space are filtered by that person's ears. Camera images are normalized in ways that allow mapping algorithms to transform the normalized image data into HRTFs. The estimation algorithm starts with a training stage. In this stage, the system accepts both image-related "input data" and the corresponding audio-related "output data" (the detailed HRTF measurements). A model of the mapping from the input data to the output data is then created. The mapping can be based upon eigen-spaces, eigen-points, a support vector network, or neural network processing, in different embodiments of the invention. Once the training stage is complete, the model is used to estimate the output data solely from input data: the model gives the HRTF from the processed input imagery. This second stage of operation is referred to as the estimation stage. Thus, given an ear whose HRTF has never been measured, it becomes possible to determine an HRTF for that ear.

Further details regarding the HRTF estimation technique of the present invention are explained hereinafter with reference to specific embodiments illustrated in the accompanying figures.

DETAILED DESCRIPTION

Figures 1, 2:
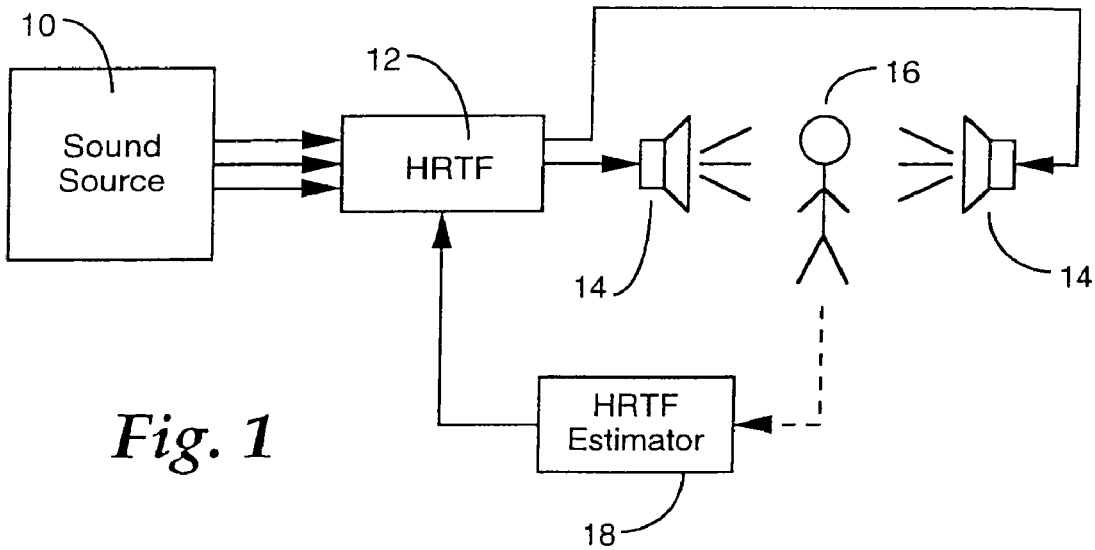
FIG. 1 is a general block diagram of a system for generating spatial sound with the use of an HRTF.
FIG. 2 is an illustration of an HRTF vector for one individual.

Generally speaking, the present invention is directed to the estimation of an HRTF for a particular listener, based upon information that is available about physical characteristics of that listener. Once it has been determined, the HRTF can be used to generate spatial sound that is tuned to that listener's auditory response characteristics, so that the listener is able to readily identify and distinguish between sounds that appear to come from spatially diverse locations. An example of a system which employs the HRTF for such a purpose is schematically illustrated in FIG. 1. Referring thereto, various sounds that are respectively associated with different locations in a virtual environment are generated by a sound source 10, such as a synthesizer, a microphone, a prerecorded audio file, etc. These sounds are transformed in accordance with an HRTF 12, and applied to two or more audio output devices 14, such as speakers, headphones, or the like, to be heard by a listener 16. The HRTF describes magnitude and phase adjustments to be applied to the individual audio output devices so that, when the sounds are heard by the listener, they appear to come from sources at different locations within a three-dimensional environment surrounding the listener. To this end, therefore, the HRTF 12 must be based upon the auditory response characteristics of the particular listener. In accordance with the present invention, the HRTF 12 which is employed for a given listener 16 is provided by an estimator 18, which computes an appropriate HRTF on the basis of observable features of the listener 16.

The information content of the sounds produced by the source 10 will vary according to the particular application in which the system is employed. For example, in an acoustic display for air-traffic controllers, different sounds such as pilots' voices can be associated with different arriving and departing aircraft, and their virtual locations relative to the listener can be associated with the positions of the aircraft in the airspace and/or on the ground. In a teleconferencing application, the HRTF causes the voices of different participants in the conference to sound as if they are coming from different locations, which might be associated with the positions of the participants around a table, for instance. Examples of systems which utilize HRTFs to provide these types of effects are described in Begault, Durand R., 3-D Sound for Virtual Reality and Multimedia, (Boston: AP Professional, 1994).

An HRTF is based upon measurements of the response of a listener to a variety of audible signals from sources at different respective azimuths and elevations, relative to that listener. For each signal, the HRTF might take into account the magnitude and the phase of the signal spectrum at both ears of the listener. For a given listener, therefore, the HRTF can be represented by means of a vector containing data for the measured responses of the listener. An example of such a vector is illustrated in FIG. 2. In this particular example, the same sound, e.g., a click, is generated at a number of different locations around the listener's head. For each such position, defined by azimuth and elevation, the frequency dependent magnitudes M and phases P of the sound at the listener's eardrum are recorded for both the left and right ears. Thus, if 200 different source positions are employed in the measurement, the vector would contain 400 data elements for each audible frequency, where each data element comprises a pair of phase and magnitude measurements. Once the HRTF has been determined for the listener, the measured values can be used to filter the sound signals generated by the sound source 10, to create the impression that the various sounds are coming from spatially displaced locations.

The explicit determination of an HRTF for an individual, by performing multiple measurements as described above, is only feasible for applications which might have a limited number of users. For many applications, therefore, it is preferable to be able to estimate an HRTF which is appropriate for the individual users on the basis of information which is more easily obtainable than the actual sound measurements. In accordance with the present invention, an estimate of an HRTF for a person is based upon observable characteristics of that person's physique. One of the primary influences upon a person's spatial sound response is the shape of the person's outer ear, or pinna. Another factor is the shape and size of the person's head, particularly the spacing between the ears, since it determines the phase delay between the sounds heard at the two ears. A third factor is the width and shape of the person's shoulders, which play a role in the diffraction of the sound waves. In the technique of the present invention, images of a person which provide input data relating to one or more of these physical factors are used to estimate that person's HRTF.

To facilitate an understanding of the present invention, its basic concepts will first be described with reference to a relatively simple example, followed by a discussion of more detailed aspects that might be employed in a practical implementation of the invention.

Figures 3, 4:
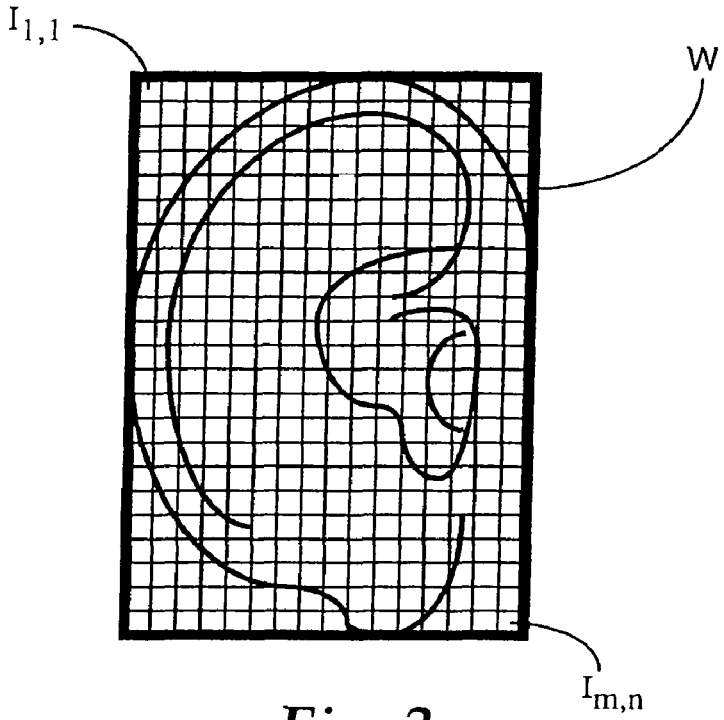
FIG. 3 is an illustration of data points for an image of an ear.
FIG. 4 is a matrix of image data points and HRTF data values that is used to compute a coupled model.

Referring to FIG. 3, an image of a person's ear can be used to provide input data which enables different shaped ears to be distinguished from one another. Depending upon the number and variety of listeners for whom estimates are to be made, a single image of one ear for each person might provide sufficient input data. For greater accuracy, it may be preferable to utilize images of both of the person's ears. For even more input data, multiple views of both ears from different angles, e.g. profile and perspective views, might be employed to provide three-dimensional information.

In a similar manner, an image of the listener's head, with or without the shoulders included, can be used to identify other relevant data. Each of these images provides items of observable data that can then be used to estimate the HRTF. For instance, all of the pixel values $I_{i,j}$ for an image together define a vector of observable values, e.g. the value of the pixel in the upper left corner of the image, $I_{l,l}$ is the first element of the vector, and the value of the pixel in the lower right corner, $I_{m,n}$ is the last element of the vector. If more than one image is employed, the individual vectors can be concatenated to produce a comprehensive vector. For an individual whose HRTF is known, this vector of observable values can be combined with the HRTF vector to compute a coupled estimation model. In this particular example, the model is based upon an eigen-space defined by the images(s). The eigen-space estimation model defines the coupling between observable data, in this case pixel values in an image, and hidden data, namely the HRTF data values.

Figure 5A:
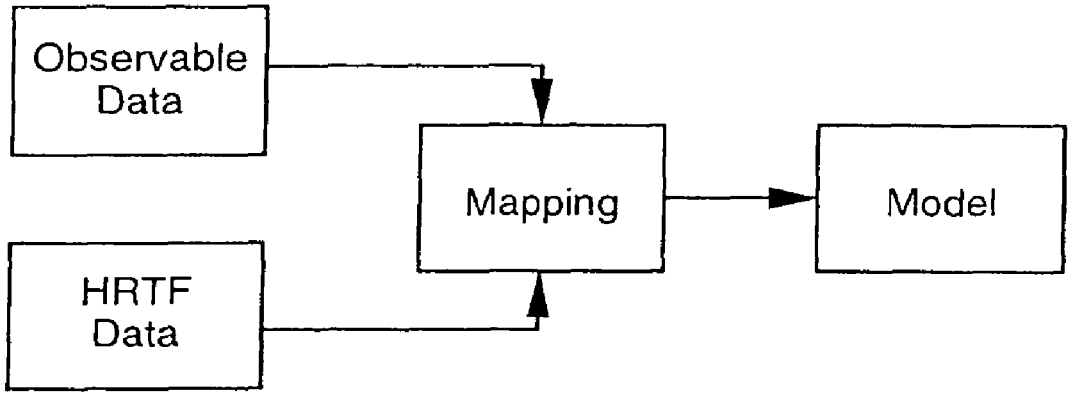
FIGS. 5*a* and 5*b* depict the training and estimation stages of the HRTF estimator, respectively.

The estimation model is based upon known data from a number of individuals. In one embodiment of the invention, the model is computed from a matrix of vector mappings for individuals whose HRTFs have been measured. An example of such a matrix is shown in FIG. 4. Each row of the matrix corresponds to a different individual. Within each row, a first set of data values $I_{i,j}$ is defined by the individual pixel values of the image(s) of the person. As described in detail hereinafter, this image data can be augmented with specific measurements of certain physical features of the person. A second set of data values Pi comprises the measured HRTF values for that person at each measurement position. By obtaining the observable image data and HRTF values for a number of individuals, a mapping matrix of the type shown in FIG. 4 can be constructed. This mapping of observable data to HRTF values for individuals whose HRTFs are known constitutes the training stage of the HRTF estimation process, as depicted in FIG. 5*a*. The greater the amount of input data that is employed in this mapping, both in terms of number of individuals and data per individual, the more reliable the coupling between the input and output data becomes.

Figure 5B:
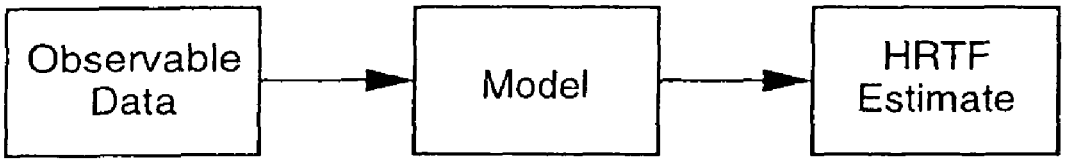

Once it has been formulated, such a mapping can be used to compute a coupled model for the estimation of unknown HRTFs. More particularly, for a new listener whose HRTF is unknown, one or more images of that person are obtained, to provide the relevant data for that person's ears, head, shoulders, etc. The pixel values obtained from such images are applied to the model. In return, the model produces an estimate of the HRTF for that person, as depicted in FIG. 5*b*. Further information regarding one approach that can be used for the computation and use of a coupled model to estimate hidden data from observable data is described in U.S. patent application Ser. No. 08/651,108, the disclosure of which is incorporated herein by reference. In the implementation of the invention, the HRTF estimator 18 is preferably a suitably programmed computer which receives the image data and measured HRTFs for a number of individuals, computes the coupled model as described in that application, and then estimates an HRTF for a new subject on the basis of image data from that subject.

In this example, the image data that is input to the coupled model can be normalized for all individuals. In one approach, this normalization can be provided by means of a controlled imaging arrangement. For instance, each person can stand at a fixed position relative to a standardized camera for each different input image, so that the data is consistent for all individuals. In some cases it may not be practical or desirable to use images that are provided by such an arrangement. In these situations, other images sources, such as photographs obtained in uncontrolled settings, might be used. For these cases, the images themselves can be scaled and rotated as appropriate to provide the necessary normalization. For instance, with reference to FIG. 3, the image can be scaled along each of the x and y axes, so that the extremities of the ear lie on the border of a window W of predefined size, e.g. m pixels by n pixels. All of the pixel values within this window then provide the observable data values. The same approach can be employed for images of the head, or head and shoulders combined. Preferably, the scaling factor is the same for both the x and y axes, to avoid distortion of the aspect ratio of an original image.

The embodiment of the invention described in the foregoing example is based upon a coupled eigen-space model, which permits an HRTF for an individual to be computed directly from one or more images of that individual. Various types and combinations of observable input data can be used in the computation of the model and the estimation of an HRTF. Based upon current research, it appears that the shape of the pinnae may be the most significant factor in the HRTF. Therefore, it may be preferable to use a high resolution image of the individual's ear for the observable data, to obtain a sufficient amount of detail. If additional images are used of the person's head, and/or head and shoulders, it may be acceptable to employ lower-resolution images for these views, and thereby reduce the amount of data that is to be processed. For instance, the images of the pinnae might have a resolution of eight bits per pixel, to provide a large number of grayscale values that permit the shapes of individual features to be readily taken into account. In contrast, a silhouette image may be acceptable for the head and shoulders, in which case the image need only have a resolution of one bit per pixel. Further in this regard, the pixel density of the images of the head and shoulders might be lower than the images of the pinnae.

In addition to image data, e.g. pixel values, other forms of observable data can be employed to augment the information in the model. In particular, geometric dimensions which are obtained from measurements of the individual can be used in combination with the image data. Suitable examples of such dimensions include the widths of the listener's head and shoulders, and the separation distance between the listener's ears and shoulders. When dimensional data of this type is employed, it may be feasible to reduce the amount of image data that is needed. For instance, a medium resolution image of the ears can be used in combination with direct measurements of physical dimensions of the listener to compute the model. In another example, the appropriate dimensions can be estimated from the images of the head and shoulders, and used in combination with an image of the pinna.

With the basic principles of the invention having been described, more detailed features thereof, which might be employed in its implementation, will now be set forth. In general, a number of measurements and images can be used as input data for the HRTF estimator: (1) radii describing the head shape in terms of a simple 3D ellipsoid; (2) offset distances from the axes of the head-shape ellipsoid to the ear canal on the subject; (3) a rotation parameter, describing how the ear is oriented on the head-shape ellipsoid; (4) an "ear warp" image; (5) a warped "ear appearance" image; and (6) "distance-to-silhouette" images of the head profile and the head-and-shoulders front view. The final output from the HRTF estimator is an estimate of that person's HRTF. The HRTF is expressed with the following parameters: (1) the deviation of the interaural time delay from the expected delay, for each elevation/azimuth; (2) a "frequency warp" function; and (3) the warped Fourier-transform magnitude for the HRTF. Each of these types of input and output data are discussed hereinafter.

The head can be approximated using a simple ellipsoid. The first three inputs (the radii describing the head, the offset of the ears on the head, and the rotation of the ears on the head) are derived from this simple head model. The lengths of the three semi-axes of the ellipsoid can be determined using one of a variety of methods: from physical measurements on the subject; from manual extraction of distance measurements from the front and profile views of the subject's head; or from an automatic estimate of the distance measurements, using image processing on the front and profile views of the subject's head. Once this ellipsoidal head model is obtained, similar methods can be used to determine where the ears are located and their rotational orientation relative to the horizontal, side-to-side axis of the ellipse.

Automatic image processing methods can be used to find the rotation of the ear. This might be done by simultaneously finding the global rotation and the spatial warp of a "canonical ear template" relative to the subject's ear, such that the correlation between the warped, rotated template and the side view of the subject's ear is maximized. To do so, each pixel in the canonical ear template is mapped to a corresponding pixel in the image of the subject's ear, and the displacement between them is determined. Warping of the canonical ear template in accordance with these displacement values produces an image corresponding to the subject's ear. That is, each pixel (x,y) in the warped image gives the amount to offset the canonical ear template at that location in order to make the canonical ear template look like the subject's pinna.

To avoid unrealistic mappings, topological constraints on this procedure can be used, e.g. the warping function can not "tear", "fold", or "flip" the ear template. If desired, a penalty term which increases with increasingly non-linear warping functions can also be included. In one implementation, the warping function is otherwise unconstrained: it can use any displacement values that optimize the criteria. In another implementation, the warping function is constrained to move pixels in a radial manner, with the origin of the radii being at the ear canal. The first implementation is more general and will sometimes find better matches between the subject's ear and the canonical ear. The second implementation has the advantage of reducing the dimensionality of the search space. A rigid-body rotation of the ear and the two-dimensional "image" of the warp function are used as input data for the HRTF estimator. The ear warp is presented to the HRTF estimator in the pixel domain of the canonical ear. Representing the warp image in the canonical ear coordinates (instead of in the subject's ear coordinates) is preferred, since it describes the information about specific landmarks of the ear with reference to known locations.

When processing images to estimate the HRTF, the procedure should be independent of skin color differences between various subjects. This can be accomplished by using gray-scale image information as the input data. In one aspect of the invention, the color direction for gray is aligned with the skin color of the subject. Once the canonical ear template is warped so that it will match the subject's pinnae, that mapping can be used to "back-warp" the image of the subject's pinnae to match the canonical ear. This back-warping gives the colors of the subject's ear in the geometric shape of the canonical ear. The HRTF estimator then models the basic skin color of the subject by fitting a one-dimensional manifold in color space to the colors seen in the subject's image below and in front of the determined ear location. The warped color image of the subject's ear image is then remapped into a new two-dimensional color space. The first dimension of the new color space is the projection of the pixel color onto the one-dimensional manifold that is fitted to the skin colors. The second dimension of the new color space is the distance between the pixel color and the one-dimensional manifold. This choice for a color space has the advantage of adapting to the coloration and the color balance of the subject's image. In addition, the second dimension enables portions of the image that are not likely to be skin, such as hair, to be readily distinguished, since they provide large distance-to-skin-color values.

If desired, the image levels in this two-dimensional color space can be normalized by histogram modification. See, for example, Lin, Two-Dimensional Signal and Image Processing, Prentice Hall, N.J., 1990, pp. 455-459, for a description of such a modification. This step provides invariance to changes in lighting. This normalized warped image in the new color space is another input into the HRTF estimator.

"Distance-to-silhouette" images of the head profile and the head-and-shoulders frontal view can also be used as input data into the HRTF estimator. The "distance-to-silhouette" image starts from a binary silhouette, following the outline of the subject against the background. This silhouette might be obtained with controlled backgrounds (to allow background subtraction) or with human appearance modeling, using a technique such as that described in Wren, Azarbayejani, Darrell, Pentland, "Pfinder: Real-time Tracking of the Human Body" IEEE Trans Pattern Analysis and Machine Intelligence, 19:7, July 1997. Once the silhouette of the subject is obtained, the bilevel image is converted to a signed "distance-to-silhouette" image, for example by using techniques similar to those described in Ragnemalm, "Contour Processing Distance Transforms", Progress in Image Analysis and Processing, Cantoni et al., eds., World Scientific, Singapore, 1990, pp 204-212. A signed distance image can be obtained by extending the standard Euclidean Distance Transform (EDT), which measures distances from each background pixel to the nearest foreground pixel. The signed extension also measures the distance from each foreground pixel to the nearest background pixel and gives these foreground-to-nearest-background distances the opposite sign as the background-to-nearest-foreground distances. For example, when processing the silhouette of the subject's head, the pixels of the distance-to-silhouette image that are inside the subject's head's support will be positive-valued and the pixels of the distance-to-silhouette image that are outside the subject's head's support will be negative-valued and, at all pixels, the magnitude will be the distance to the silhouette's boundary. The head profile image can be preprocessed to normalize the scaling of the image (so that a pixel covers a known distance on the subject's head), and the images are shifted and rotated so that the ear canal appears in a known location within the image and the pinnae is shown in a known orientation. This translation and rotation is determined when fitting the ellipsoidal head-shape model and finding the rigid rotation of the ear on the head model. Similarly, in the head-and-shoulders frontal view, the image can be preprocessed to normalize the scaling of the image (so that a pixel covers a known distance on the subject's head) and the images are shifted so that the midpoint between the two ears appears in a known location. This translation is found by first finding the two ears, using matched filtering.

Other inputs that can be used if they are available include three-dimensional shape models of the ears. This three-dimensional data can be determined from any of a variety of stereo algorithms or they can come from scanner or probe information. For example, one approach to shape determination using multiple images from different viewpoints is the level-set algorithm described by Faugeras and Keriven, "Variational Principles, Surface Evolution, PDE's, Level Set Methods, and the Stereo Problem," *INHA Technical Report* 3021, 26 Oct. 1996. That method uses multiple images of an object, and a variational approach, to find the best shape to fit the data.

The output data can also take different forms. The ultimate objective is to determine coefficients for causal time-domain filters that describe the HRTF at all possible elevations and azimuth angles. However, the time-domain HRTF is not necessarily the best representation to use as the target output domain. Instead, for each angle, the HRTF response can be represented as a time delay deviation from an expected interaural time delay, a frequency-warping function, and a frequency-warped, magnitude-only Fourier representation. Each of these output data will be described in turn. Then, in the estimation stage, these outputs are used to obtain the causal, time-domain HRTF, corresponding the new subject's image data.

The first output is the deviations of the interaural time delay (ITD) from their expected values at each azimuth and elevation angle. The expected interaural time delay is estimated from the ellipsoidal model of the head shape and from the offset distances from the axes of the head-shape ellipsoid to the ear canal on the subject. All of these values are explicitly estimated as input data. Using these measurements and assuming simple diffraction of the sound wave around the head ellipsoid, an expected ITD is computed for each azimuth and elevation angle. During the training stage, the actual ITD is determined by finding the time of the first (significant) peak in each of impulse responses for the two ears at each azimuth and elevation angle. Given those peak locations, the actual ITD at each azimuth and elevation is the difference between the first-peak times of the two ears. The observed ITDs are subtracted from the expected ITDs, to find the deviation from the expected ITD. During the training stage, these time-delay deviations are provided to the HRTF estimator model, so that it can learn how to estimate the deviation from the input data. During the estimation stage, the HRTF model estimates the deviation.

The next output data are frequency-warping functions for the subject's HRTF at each azimuth and elevation. During the training stage, these warping functions are used to match the subject's frequency-domain, magnitude-only HRTF with a canonical frequency-domain, magnitude-only HRTF. In one implementation, a single frequency-warping function is used to warp all azimuths and elevations. In another implementation, different frequency-warping functions can be used for each azimuth and elevation. In both implementations, the warping function is found using dynamic "time" warping (DTW). For an example of such, see Deller et al, "Dynamic Time Warping", Discrete-time Processing of Speech Signals, New York, Macmillan Pub. Co., 1993, pp. 623-676. The process begins with a "neutral estimate", i.e., a slope which correctly scales the frequency domain to normalize the average size of the subject's pinnae to a canonical size. From that neutral slope, the actual DTW slope is allowed to vary smoothly, in order to match the subject's HRTF to the canonical Fourier-domain (magnitude-only) HRTF. One criteria that can be used for finding a single, global warping function is the mean-squared error, averaged across all elevations and azimuths. When distinct warping functions are used for each azimuth and elevation, this single, global warping function is used at the start and then relaxation techniques are employed to allow the warping function for each azimuth and elevation to move smoothly from the starting point. As with the warping function for the ear images, this warping function is described using the frequency axis of the canonical HRTF (as opposed to the frequency axis of the subject's HRTF). During the training stage, the warping functions are provided to the HRTF estimator model, so that it can learn how to estimate its values from the input data. During the estimation stage, the HRTF model provides an estimate for these warping functions.

Once a warping function is obtained, the frequency-warped, magnitude only Fourier representation of the subject's HRTF is determined. This frequency-domain, magnitude-only HRTF is represented in the warped frequency domain, so that "landmark" resonances will be in or near known frequency bins: the bin location for these resonances typically will not change much from one subject to the next. The warped frequency-domain, magnitude-only HRTF provides information about the strength of each of these resonances. During the training stage, the warped frequency-domain, magnitude-only HRTF is provided to the HRTF estimator model, so that it can learn how to estimate its values from the input data. During the estimation stage, the HRTF model provides an estimate for these values.

Once the training stage has been completed and a model is built, the estimation stage is run for any desired subject. The model is given the images of the subject and it returns its estimates for the corresponding HRTF description. At the end of the estimation stage, estimates are provided for the deviation from the expected ITD, the frequency-domain warping function(s) for the HRTF, and the warped, frequency-domain, magnitude-only HRTF. Causal, time-domain HRTF impulse responses are constructed from this information. This is done by first dewarping the magnitude-only frequency domain representation. Then a minimum-phase reconstruction is carried out, for example, as described in Oppenheim and Schafer, Discrete-Time Signal Processing, Prentice Hall, N.J., 1989, pp. 779-784. Finally, the minimum-phase reconstructions are shifted according to the corrected ITD. The corrected ITD is given by the ITD deviations (that were estimated as one of the outputs) and the ITD prediction given by the head-shape ellipsoid and the ear-offset distances. Head-shape ellipsoid and the ear-offset distances are available from the input data. This gives a complete HRTF for a new subject.

In the foregoing embodiments of the invention, a coupled eigen-space model has been described for the estimation of an individual's HRTF. The eigen-space model provides a linear coupling between the observable data and the HRTF. In some situations, it may be preferable to employ higher-order dependencies between the observable and hidden data. One technique for capturing such dependencies is based upon support vector networks, as described for example in Advances in Kernel Methods: Support Vector Learning, edited by Bernhard Scholkopf, Christopher J. C. Burges, Alex J. Smola, Alexander J. Smola, MIT Press; ISBN: 0262194163. Rather than eigen-spaces, therefore, it is possible to use a support vector network to compute the coupled model. As another alternative, it is possible to employ neural network processing, as described, for example, in *Neural Networks for Pattern Recognition*, by Christopher M. Bishop, Oxford Univ. Press; ISBN: 0198538642.

It will be appreciated by those of ordinary skill in the art that the present invention can therefore be embodied in other specific forms without departing from the spirit or essential characteristics thereof. The presently disclosed embodiments are therefore considered in all respects to be illustrative and not restrictive.

What is claimed is:

1. A computer-readable medium containing a program which executes the steps of:

computing an estimation model using (1) information associated with head-related transfer functions for each of multiple individuals and (2) information associated with physical characteristics for each of the multiple individuals obtained using at least one image of each of the multiple individuals, wherein the estimation model maps physical characteristics of the multiple individuals to audio-related HRTF data for the individuals, respectively;

receiving physical characteristics for a subject whose HRTF is unknown using at least one image of the subject whose HRTF is unknown; and processing the received physical characteristics in accordance with the model to produce an estimate of an HRTF for the subject whose HRTF is unknown.

2. The computer-readable medium of claim 1 wherein the physical characteristics are derived from an image of an individual's ear.

3. The computer-readable medium of claim 2 wherein the image includes the individual's head, and the physical characteristics include the location of an ear on the head.

4. The computer-readable medium of claim 2 wherein the physical characteristics include the shape of the individual's ear.

5. The computer-readable medium of claim 1 wherein the physical characteristics include physical dimensions of an individual.

6. The computer-readable medium of claim 5 wherein the physical dimensions are derived from an image of the individual.

7. The computer-readable medium of claim 1 wherein the estimation model comprises a coupled eigen-space model.

8. The computer-readable medium of claim 1 wherein the estimation model is based upon a support vector network.

9. The computer-readable medium of claim 1 wherein the computing and processing steps are implemented with neural network processing.

* * * * *

UNITED STATES PATENT AND TRADEMARK OFFICE

CERTIFICATE OF CORRECTION

PATENT NO. : 7,840,019 B2
APPLICATION NO. : 11/274013
DATED : November 23, 2010
INVENTOR(S) : Malcolm Slaney et al.

It is certified that error appears in the above-identified patent and that said Letters Patent is hereby corrected as shown below:

In column 1, line 12, delete "1999,now" and insert -- 1999, now --, therefor.

Signed and Sealed this
Eighth Day of February, 2011

David J. Kappos

David J. Kappos
*Director of the United States Patent and Trademark Office*